US005909608A

United States Patent [19]

Manno et al.

[11] Patent Number: 5,909,608

[45] Date of Patent: Jun. 1, 1999

[54] TENSION SUPPORT MOUNTING FOR A CORONA GENERATING DEVICE

[75] Inventors: Eugene J. Manno, Ontario; James W. Patterson, Palmyra; Daniel P. White, Honeoye Falls, all of N.Y.

[73] Assignee: Xerox Corporation, Stamford, Conn.

[21] Appl. No.: 09/001,771

[22] Filed: Jan. 7, 1998

[51] Int. Cl.[6] ..... G03G 15/02

[52] U.S. Cl. ..... 399/173; 250/325

[58] Field of Search ..... 399/170–173, 399/115, 121; 250/324–326

[56] References Cited

U.S. PATENT DOCUMENTS

| | | | |
|---|---|---|---|
| 3,578,970 | 5/1971 | Michaud et al. | 399/169 |
| 3,691,373 | 9/1972 | Compron et al. | 250/49.5 |
| 4,110,811 | 8/1978 | Hubble, III et al. | 361/225 |
| 4,322,156 | 3/1982 | Kohyama | 399/50 |
| 4,725,372 | 2/1988 | Lang et al. | 250/326 |
| 5,229,819 | 7/1993 | Beresniewicz et al. | 399/172 |
| 5,257,073 | 10/1993 | Gross et al. | 399/171 |
| 5,324,941 | 6/1994 | Gross et al. | 250/324 |
| 5,440,375 | 8/1995 | Fujisawa et al. | 399/171 |

*Primary Examiner*—Robert Beatty

[57] ABSTRACT

A tension support mounting for applying tension to the corona generating electrode of a corona generating device. A corona generating electrode is placed in cooperative engagement with a fixedly mounted end block via a torsion spring member mounted on the endblock.

15 Claims, 5 Drawing Sheets

TENSION SUPPORT MOUNTING FOR A CORONA GENERATING DEVICE

The present invention relates generally to corona charging devices, and more particularly concerns a tension support mounting for supporting a corona generating electrode in a corona generating device utilized in electrostatographic applications.

Generally, the process of electrostatographic copying is executed by exposing a light image of an original document to a substantially uniformly charged photoreceptive member. Exposing the charged photoreceptive member to a light image discharges the photoconductive surface thereof in areas corresponding to non-image areas in the original document, while maintaining the charge on image areas to create an electrostatic latent image of the original document on the photoreceptive member. The electrostatic latent image is subsequently developed into a visible image by a process in which a charged developing material is deposited onto the photoconductive surface of the photoreceptor such that the developing material is attracted to the charged image areas thereon. The developing material is then transferred from the photoreceptive member to a copy sheet on which the image may be permanently affixed to provide a reproduction of the original document. In a final step, the photoconductive surface of the photoreceptive member is cleaned to remove any residual developing material therefrom in preparation for successive imaging cycles.

The described process is well known and is useful for light lens copying from an original, as well as for printing documents from electronically generated or stored originals. Analogous processes also exist in other electrostatographic applications such as, for example, digital printing applications wherein the latent image is generated by a modulated laser beam.

In electrostatographic applications, it is common practice to use corona generating devices for providing electrostatic fields to drive various machine operations. Such corona devices are primarily used to deposit charge on the photoreceptive member prior to exposure to the light image for subsequently enabling toner transfer thereto. In addition, corona devices are used in the transfer of an electrostatic toner image from a photoreceptor to a transfer substrate, in tacking and detacking paper to or from the imaging member by applying a neutralizing charge to the paper, and, generally, in conditioning the imaging surface prior to, during, and after toner is deposited thereon to improve the quality of the xerographic output copy. Because a relatively large number of corona generating charging devices are required to accomplish the many various operations in a single electrostatographic machine, a minor improvement or reduction in unit cost may reap significant advantages per machine, particularly in light of the operation life of the unit and replacement cycles in a machine.

The conventional form of corona generating charging device used in electrostatographic reproduction systems is generally shown in U.S. Pat. No. 2,836,725. That patent discloses a basic corotron device wherein a conductive corona generating electrode in the form of an elongated wire is partially surrounded by a conductive shield. The corona generating electrode, or so called coronode, is provided with a relatively high DC voltage to cause ionization of the air immediately surrounding the coronode, while the conductive shield is usually electrically grounded to direct the ions toward the surface to be charged. Alternatively, the corotron device may be biased in a manner taught in U.S. Pat. No. 2,879,395, which describes a device known as a scorotron, wherein an AC corona generating potential is applied to the conductive wire electrode while a DC biasing potential is applied to a conductive shield partially surrounding the electrode. This DC potential regulates the flow of ions from the electrode to the surface to be charged so that the charge rate can be adjusted, making this biasing system ideal for self-regulating systems. Countless other charging and biasing arrangements are known in the art and will not be discussed in great detail herein.

In one type of charging device of particular interest with respect to the present invention, a charging electrode may be provided in the form of an electrically conductive strip having projections, scalloped portions, or teeth members integrally formed with, and extending from, a longitudinal edge of the electrode. This arrangement, known as a pin array electrode, provides significant structural and operational advantages over other types of electrode devices such as thin wire electrodes, including comparatively high structural strength, greater charge uniformity and reduced levels of undesirable ozone emissions. In this respect, U.S. Pat. No. 3,691,373 to Compton et al. demonstrates a corona generating device generally comprising a pin array electrode supported on either side by support strips, and mounted within an electrically nonconductive base member. One of the side strips is adapted for connection to an exterior connector from a high voltage source. The electrode is fixed into position within the base member by a plurality of transverse pins which fit through matching holes in the base member, the pin array, and the support strips. The corona generating device disclosed therein may further include a screen and/or an auxiliary electrode as well as various additional conductive shields for regulating charging current to control uniformity of charge. A detailed description and illustration of pin array corona generating devices, specifically describing the mounting mechanism used to support a pin array electrode in a corotron device is provided in U.S. Pat. Nos. 4,725,732 and 4,792,680, the entire contents of which are hereby incorporated by reference herein.

Several problems have historically been associated with the unique design of pin array corona generating devices. Generally, it is important that the pin array electrode, which is typically stretched between mountings at opposite ends of the corona generating device, is maintained under tension so as to be in a taut condition. Any looseness and/or kinks in the electrode member may result in a non-uniform charge derived from the corona generating device. In order to insure that the electrode member is sufficiently supported, the pin array electrode is conventionally mounted between support members, as shown in previously referenced U.S. Pat. Nos. 4,725,732 and 4,792,680.

It is also desirable, in corona generating devices, to provide an arrangement for easily replacing faulty or a deteriorated corona generating electrode upon failure, or preferably, for replacing a corona generating electrode prior to failure through preventative maintenance. Typically, the replacement of a pin array electrode necessitates replacement of the entire assembly of the corona generating device, creating waste and additional expense. Since replacement is usually handled by a service technician at the commercial site at which the machine is located, ease of replacement and adjustment in a minimum amount of time is essential Thus, it is an object of the present invention to provide a pin array corona generating device that is cost effective and serviceable while eliminating waste by permitting the replacement and adjustment of the corona generating electrode within a corona generating device.

The following disclosures may be relevant to various aspects of the present invention:

U.S. Pat. No. 3,691,373

Patentee: Compton et al.

Issued: Sep. 12, 1972

U.S. Pat. No. 4,110,811

Patentee: Hubble III et al.

Issued: Aug. 29, 1978

U.S. Pat. No. 4,725,732

Patentee: Lang et al.

Issued: Feb. 16, 1988

U.S. Pat. No. 5,324,941

Patentee: Gross et al.

Issued: Jun. 28, 1994

The relevant portions of the foregoing disclosures may be briefly summarized as follows:

U.S. Pat. No. 3,691,373 discloses a corona charging device comprising an electrically nonconductive base member having a pin array type corona generating member mounted in the central slot thereof. The corona generating member comprises an electrically conductive central strip having a number of projections along the top edge, being supported by a pair of side strips positioned on either side. The corona generating member is held together and fastened to the nonconductive base member by a number of transverse pins fitted into matching holes in the central and side strips.

U.S. Pat. No. 4,110,811 discloses a corona generating device including a corona generating electrode in the form of a wire supported between insulating end block assemblies. Each assembly is constructed of mating half-sections which jointly define a substantially closed and insulated cavity lined with a conductive insert, wherein the electrode is held taut by means of a loaded compression spring carried within the insert on one half-section, the spring bearing against a conductive insert on the end and against a second conductive bead varied by the other end of the electrode.

U.S. Pat. No. 4,725,732 discloses a corona charging device including at least one pin array electrode having interlocking pin array support members and integral pin projections.

U.S. Pat. No. 5,324,941 discloses a tension support mounting for applying tension to a corona generating electrode of a corona generating device. Various embodiments are described wherein the corona generating electrode is fastened to a mounting block including an electrode support member, the position of which can be varied for applying variable tension to the corona generating electrode.

In accordance with one aspect of the present invention, a corona generating device is disclosed, including an electrode member for generating a corona, a fixedly mounted end block, and a torsion spring member mounted on the end mounting block and adapted to cooperatively engage the electrode for applying tension thereto.

In accordance with another aspect of the present invention a corona charging device is privided, comprising: a pin array electrode member, a shield member including a pair of side shield members; an end mounting block fixedly supported adjacent an end of the shield member, between the pair of side shield members, the end mounting block including a mounting assembly for supporting a torsion spring member; and a torsion spring member supported on the mounting assembly, wherein the torsion spring member is adapted for receiving the pin array electrode.

In accordance with another aspect of the present invention, an electrostatographic printing apparatus including a corona charging device is privided, comprising: a pin array electrode member, a shield member including a pair of side shield members; an end mounting block fixedly supported adjacent an end of the shield member, between the pair of side shield members, the end mounting block including a mounting assembly for supporting a torsion spring member; and a torsion spring member supported on the mounting assembly, wherein the torsion spring member is adapted for receiving the pin array electrode.

These and other aspects of the present invention will become apparent from the following description in conjunction with the accompanying drawings, in which.

Figure 1:
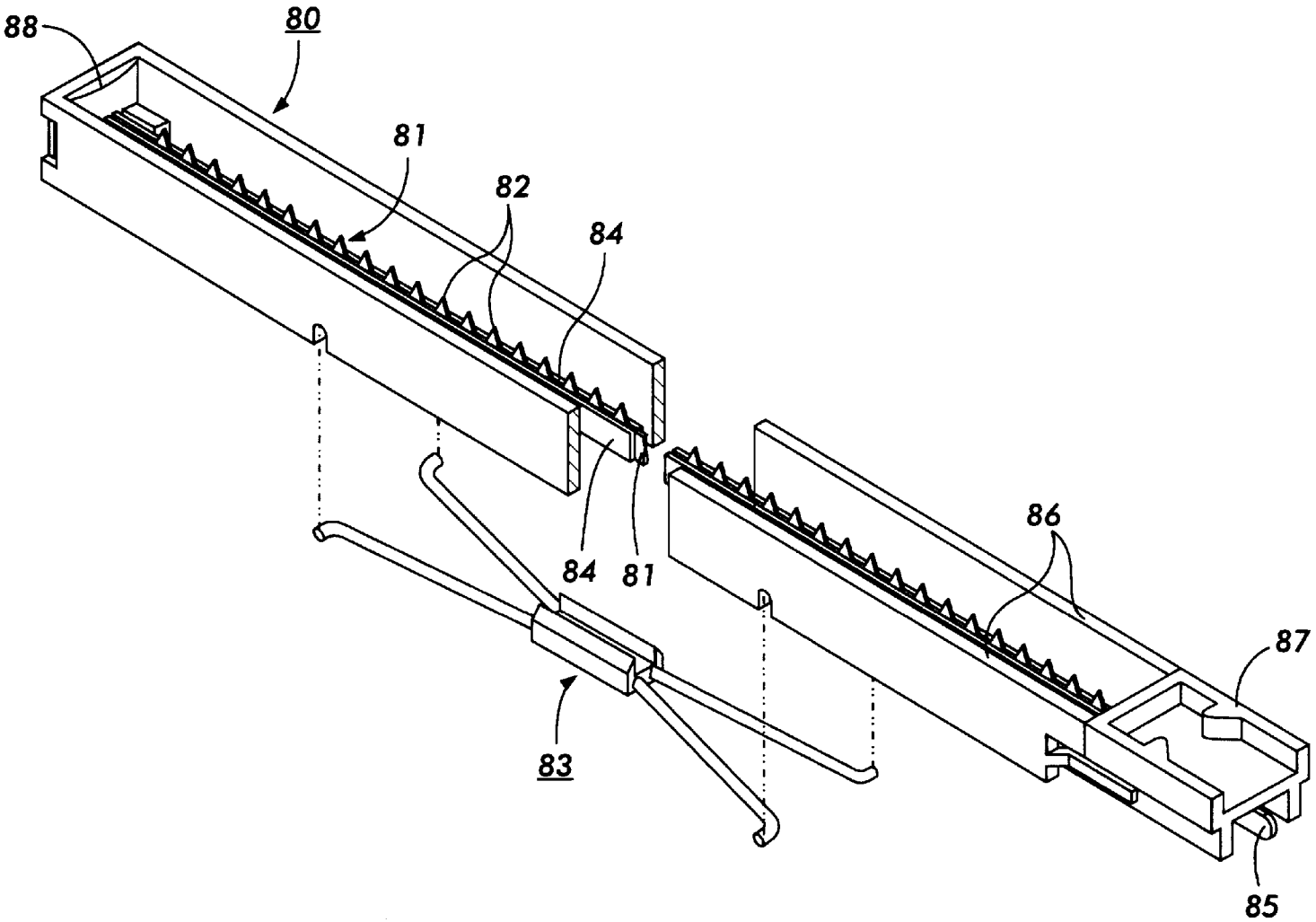
FIG. 1 is a perspective view of a prior art pin array corona generating device.

For a general understanding of the features of the present invention, reference is made to the drawings wherein like reference numerals have been used throughout the several figures where possible to designate similar elements. While the present invention will be described in terms of one particular embodiment, it will be understood that the invention is not to be limited to this embodiment. On the contrary, the present invention is intended to cover all alternatives, modifications, and equivalents as may be included within the spirit and scope of the invention as defined by the appended claims.

Figure 5:
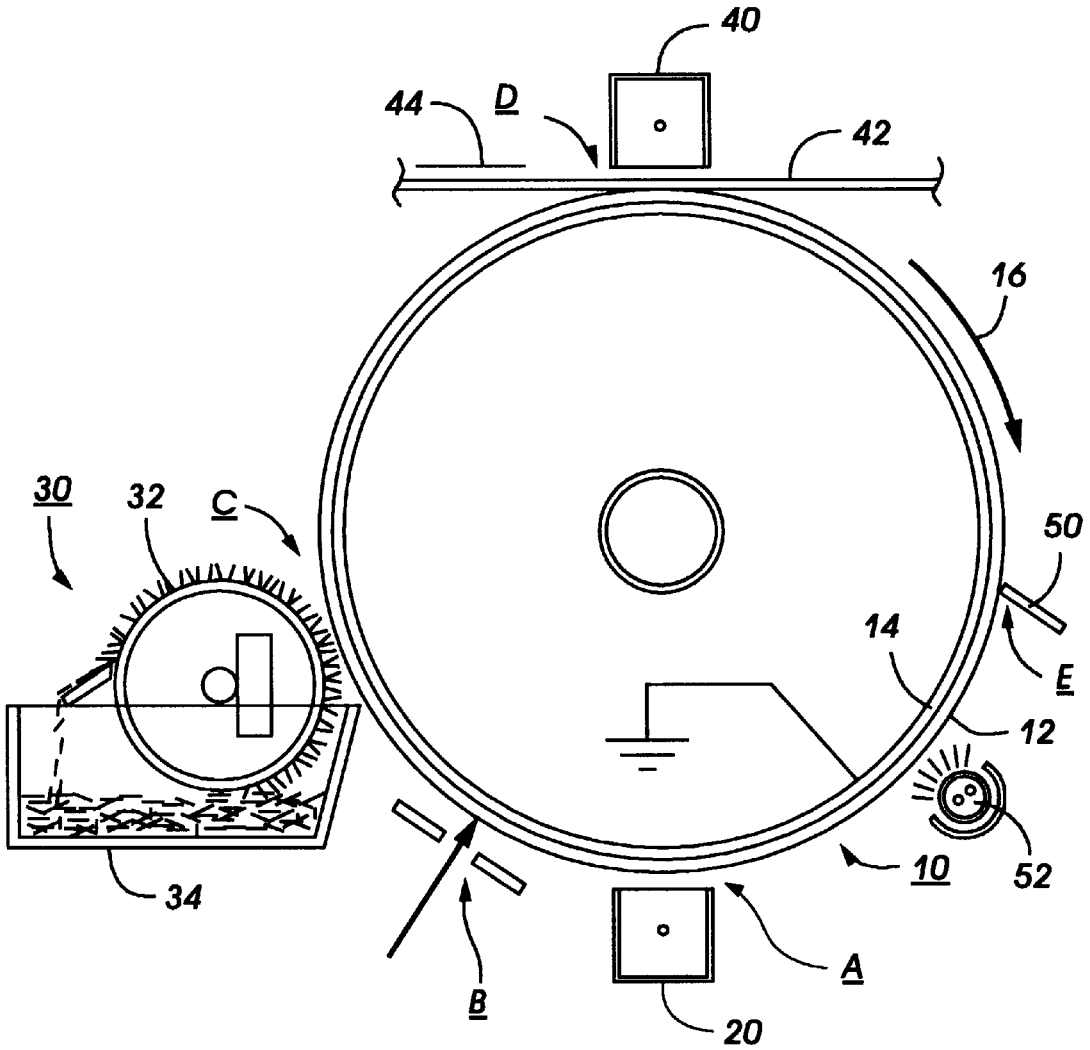
FIGS. 5 is a schematic view showing an electrophotographic copying apparatus employing at least one corona generating device.

Referring initially to FIG. 5, prior to describing the specific features of the present invention, a schematic depiction of the various components of an exemplary electrophotographic reproducing apparatus incorporating the corona generating assembly of the present invention is provided. Although the apparatus of the present invention is particularly well adapted for use in an electrophotographic reproducing machine, it will become apparent from the following discussion that the present corona generating device is equally well suited for use in a wide variety of electrostatographic processing machines as well as other systems requiring the use of a corona generating device. In particular, it should be noted that the corona generating device of the present invention, described hereinafter with reference to an exemplary charging system, may also be used in the toner transfer, detack, or cleaning subsystems of a typical electrostatographic copying or printing apparatus since such subsystems also require the use of a corona generating device.

The exemplary electrophotographic reproducing apparatus of FIG. 5 employs a drum including a photoconductive surface 12 deposited on an electrically grounded conductive substrate 14. A motor (not shown) engages with drum 10 for rotating the drum 10 in the direction of arrow 16 to advance successive portions of photoconductive surface 12 through various processing stations disposed about the path of movement thereof, as will be described.

Initially, a portion of drum 10 passes through charging station A. At charging station A, a charging device, preferably of the type disclosed by the present invention, indicated generally by reference numeral 20, charges the photoconductive surface 12 on drum 10 to relatively high, substantially uniform potential. The charging device in accordance with the present invention will be described in detail following the instant discussion of the electrostatographic apparatus and process.

Once charged, the photoconductive surface 12 is advanced to imaging station B where an original document (not shown) may be exposed to a light source (also not shown) for forming a light image of the original document onto the charged portion of photoconductive surface 12 to selectively dissipate the charge thereon, thereby recording onto drum 10 an electrostatic latent image corresponding to the original document. One skilled in the art will appreciate that various methods may be utilized to irradiate the charged portion of the photoconductive surface 12 for recording the latent image thereon as, for example, a properly modulated scanning beam of energy (e.g., a laser beam).

After the electrostatic latent image is recorded on photoconductive surface 12, drum is advanced to development station C where a development system, such as a so-called magnetic brush developer, indicated generally by the reference numeral 30, deposits developing material onto the electrostatic latent image. The exemplary magnetic brush development system 20 shown in FIG. 2 includes a single developer roller 32 disposed in developer housing 34, in which toner particles are mixed with carrier beads to create an electrostatic charge therebetween, causing the toner particles to cling to the carrier beads and form developing material. The developer roll 32 rotates to form a magnetic brush having carrier beads and toner particles magnetically attached thereto. As the magnetic brush rotates, developing material is brought into contact with the photoconductive surface 12 such that the latent image therefrom attracts the toner particles of the developing material forming a developed toner image on the photoconductive surface 12. It will be understood by those skilled in the art that numerous types of development systems could be substituted for the magnetic brush development system shown herein.

After the toner particles have been deposited onto the electrostatic latent image for development thereof, drum 10 advances the developed image to transfer station D, where a sheet of support material 42 is moved into contact with the developed toner image in a timed sequence so that the developed image on the photoconductive surface 12 contacts the advancing sheet of support material 42 at transfer station D. A charging device 40 is provided for creating an electrostatic charge on the backside of sheet 42 to aid in inducing the transfer of toner from the developed image on photoconductive surface 12 to the support substrate 42. While a conventional coronode device is shown as a charge generating device 40, it will be understood that the ionically conductive liquid charging device of the present invention might be substituted for the corona generating device 40 for providing the electrostatic charge which induces toner transfer to the support substrate materials 42. However, it will be recognized after image transfer to the substrate 42, the support material 42 is subsequently transported in the direction of arrow 44 for placement onto a conveyor (not shown) which advances the sheet to a fusing station (also not shown) which permanently affixes the transferred image to the support material 42 thereby for a copy or print for subsequent removal of the finished copy by an operator.

Often, after the support material 42 is separated from the photoconductive surface 12 of drum 10, some residual developing material remains adhered to the photoconductive surface 12. Thus, a final processing station, namely cleaning station E, is provided for removing residual toner particles from photoconductive surface 12 subsequent to separation of the support material 42 from drum 10. Cleaning station E can include various mechanisms, such as a simple blade 50, as shown, or a rotatably mounted fibrous brush (not shown) for physical engagement with photoconductive surface 12 to remove toner particles therefrom. Cleaning station E may also include a discharge lamp (not shown) for flooding the photoconductive surface 12 with light in order to dissipate any residual electrostatic charge remaining thereon in preparation for a subsequent imaging cycle.

The foregoing description should be sufficient for purposes of the present application for patent to illustrate the general operation of an electrostatographic reproducing apparatus incorporating the features of the present invention. As described, an electrostatographic reproducing apparatus may take the form of several well known devices of systems. Variations of the specific electrosatographic processing subsystems or processes described herein may be expected without affecting the operation of the present invention. For example, to those skilled in the art, the photoconductive coating of the photoreceptor may be placed on a flexible belt of either seamed or unseamed construction, continuous or not, without affecting the operation of the present invention.

Moving now to FIG. 1, there is shown a known configuration for a pin array corona generating device of the type that is commonly used in an electrophotographic reproducing apparatus of the type described hereinabove, for example as the charging device 20 located at charging station A It will be understood that the corona generating device of the present invention may also be used in a transfer, detack or cleaning subsystem since such subsystems may also utilize a corona generating device. The corona generating device of FIG. 1, generally identified by reference numeral 80 includes an electrode 81 having an array of needle-like pins 82 extending therefrom, with the electrode 81 being supported by means of a pair of elongated support members 84 extending along either side of the electrode 81, in contact therewith. As illustrated, the electrode 81 is positioned and supported within a shield support frame comprising side shield elements 86. It will be understood that the side shield elements 86 of the support frame are typically fabricated of a conductive material but may be fabricated of a non-conductive material for specific applications. The side support members 84 extend between end mounting blocks 87 and 88 for supporting the electrode between two side shield elements. The side support members 84 comprise elongated members disposed on either side of pin array electrode 81 such that the electrode 81 is sandwiched therebetween. In a typical embodiment, the pin array electrode 81 is attached in some fixed manner, to side support members 84 which, in turn, are fixedly mounted into support slots (not shown) in each end mounting block 87 and 88. A central support element 83, adapted to receive the pin electrode 81/side support member 84 combination, is also provided for being mounted to side shield member 86 so as to add structural integrity to the pin array electrode 81, as well as the corona generating device 80, as a whole.

Pin array electrode 81 preferably comprises a thin, elongate member fabricated from a highly conductive material having an array of integral projections such as pins including triangular teeth or scalloped edges along one edge thereof and extending along the entire length of an edge of the elongate electrode member so as to extend in a direction towards a surface to be charged (not shown). Pin array electrode 81 may be coupled to a high-voltage extension member 85, or may be provided with an integral high voltage extension member for permitting electrical connection of the pin electrode 81 to a high-voltage power source (not shown). The pin array electrode 81 has a length approximately equal to the width of the surface to be charged, and a height sufficient to expose the teeth thereof when mounted between the side support members 84, which is required to provide proper charging characteristics. In a preferred embodiment, the pin array electrode 81 has a thickness of approximately 0.08 mm (0.03 inches) and the teeth of pin array 82 extend approximately 3.5 mm (0.136 inches) from the top edge of the side support member 84 at a pin tip-to-pin tip interval of approximately 3 mm (0.12 inches). It will be understood that, although the present invention is described with reference to a pin array electrode, the features of the present invention described in further detail herein could be adapted for use in conjunction with various wire electrodes as known in the art and may be useful in other configurations outside of the realm of corona generating devices and assemblies in general.

It will be understood that any kind of looseness or the presence of kinks in the pin array electrode 81 is undesirable. Such looseness increases the chances of vibrations being induced in the electrode during operation thereof, and may result in non-uniform spacing of the electrode from the surface to be charged, which in turn, leads to non-uniform charging of that surface. The present invention provides a tension support mounting for supporting a corona generating electrode in an assembly of the type similar to that shown in FIG. 1 in order to alleviate the problems noted above. As such, an arrangement is provided by the present invention for exerting a tensile stress force on the electrode 81 to maintain the electrode in a taut condition. The arrangement of the present invention also allows the tension on the electrode to be released for easy removal and replacement of the electrode in the corona generating device 80.

Figure 2:
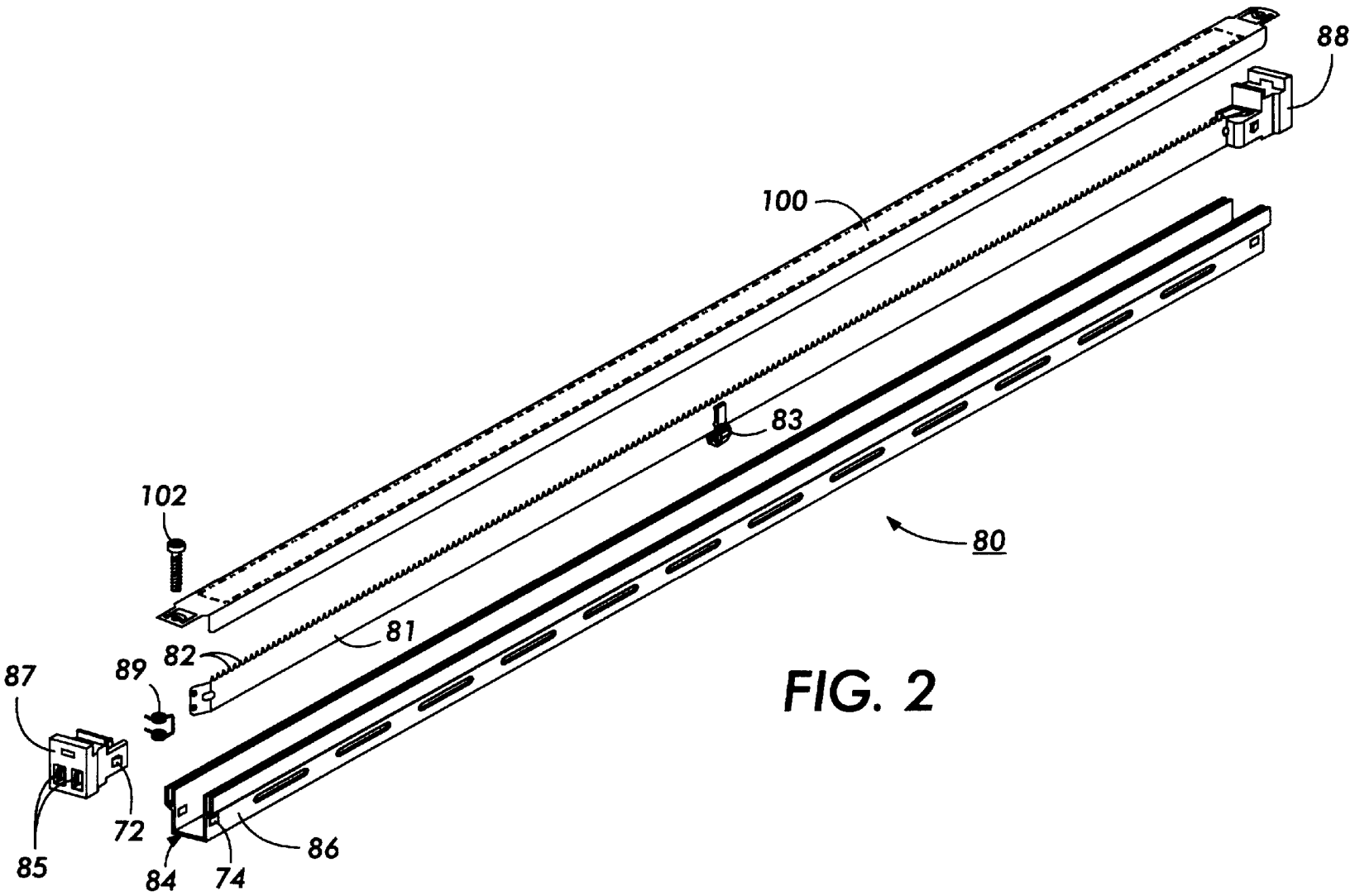
FIG. 2 is an exploded perspective view of a tension support mounting for a corona generating device in accordance with the present invention.

Referring now more particularly to FIG. 2, an exemplary embodiment of corona charging device incorporating the specific features of the present invention is illustrated and will be described in greater detail. The primary components of the corona charging device 80 are the pin array electrode 81, a U-shaped shield member 84 including side shield members 86, and end mounting blocks 87 and 88, which are substantially similar to the components shown and described with respect to FIG. 1. Each end mounting block 87, 88 is fixedly supported at opposite ends of the shield member 84 via cooperative engagement of mounting tabs 72, situated on either side of the mounting blocks, and fixed mounting support apertures 74, situated adjacent the opposed ends of shield member 84, on the side shield members 86 thereof. The exemplary embodiment of FIG. 2 also includes a central support element 83, as well as high voltage extension members 85, serving the same purposes as described with respect to the corona generating device of FIG. 1. In addition, the exemplary embodiment of FIG. 2 also includes a screen member 100 of the type generally known in the art and utilized in a specific type of corona generating device known as a "scorotron". In normal operation, the screen member 100 is disposed along the edges of side shield members 86 so as to be interposed between the electrode 81 and the surface to be charged (not shown). A mounting screw 102 may also be provided for being inserted and threaded into the mounting block 87 to facilitate mounting of screen 100 thereon.

In accordance with the present invention, at least one end mounting block of the corona charging device 80, for example end mounting block 87, includes a tension support mounting in accordance with the present invention, comprising a torsion spring 89 and a mounting assembly therefore, as will be described in great detail. The present description will proceed under the assumption that the end mounting block 88, situated opposite the tension support mounting disposed in mounting block 87 operates to support the electrode 81 in a fixed mounting position in any manner known in the art, such that only one tension support mounting in accordance with the present invention will be described. It will be understood, however, that it is contemplated that corona generating device 80 may include a pair of tension support mountings in accordance with the present invention positioned at opposite ends of the corona generating device such that each end mounting block 87 and 88 may include a torsion springs 89 and mounting systems therefore to provide the present tension support mounting for the corona generating electrode.

Figure 3:
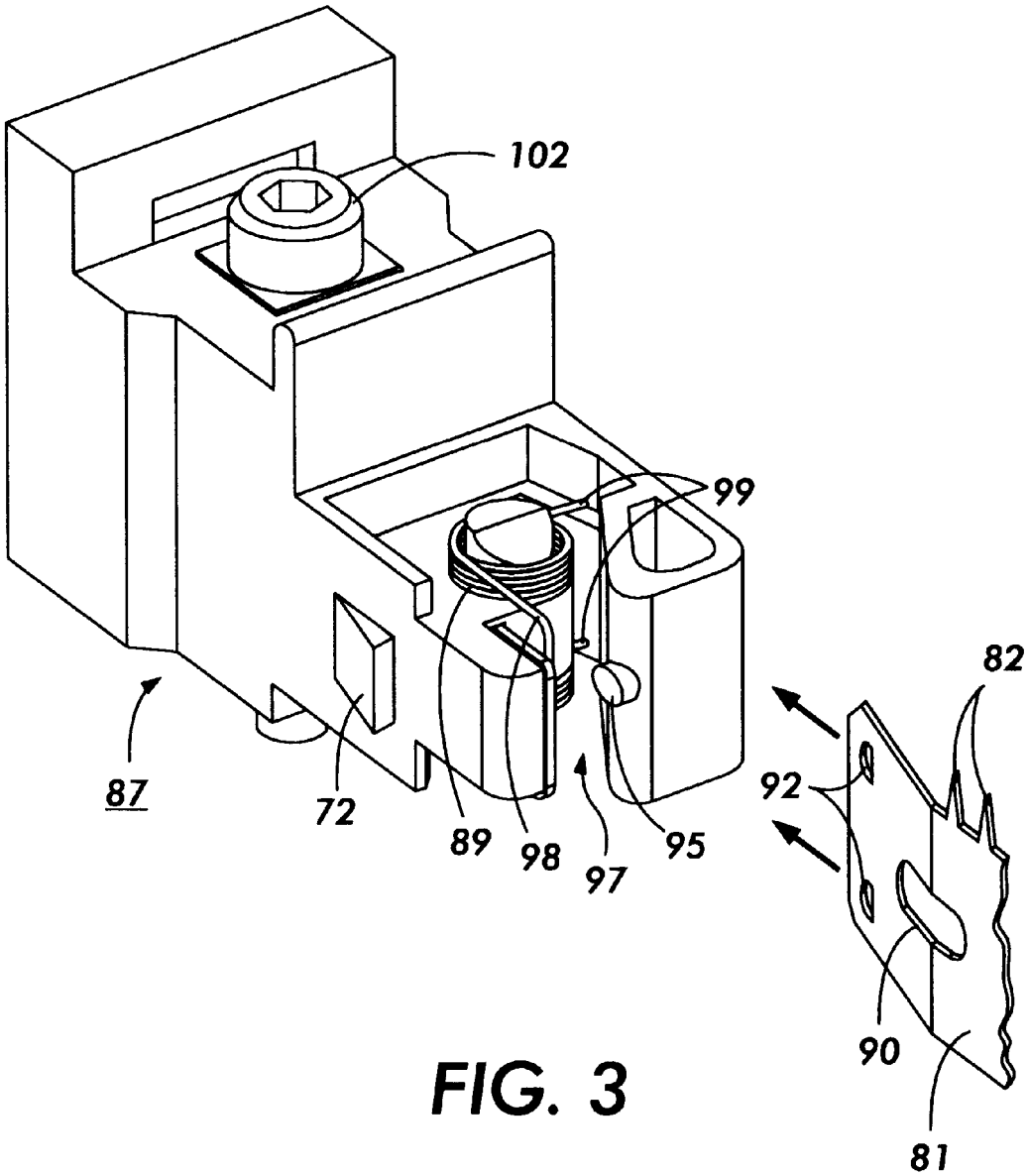
FIG. 3 is a close-up exploded perspective view of the tension support mounting for a corona generating device in accordance with the present invention.

The components making up the tension support mounting of the present invention are shown in FIG. 3, wherein it can be seen that end mounting block 87 is adapted for receiving the pin array electrode 81 via torsion spring 89. Initially, it is noted that electrode member 81 includes an end portion adapted to define an elongated alignment aperture 90 and a pair of support apertures 92, wherein these aperatures are provided for cooperative engagement with the end mounting block 87 and the torsion spring 89, respectively, as will be described.

End mounting block 87 is preferably fabricated from a high strength moldable insulating material such as a polyvinyl fluoride for preventing electrical arcing or other current flow beyond the end of the corona generating electrode 81. The end mounting block 87 is molded to define a channel 97 having an alignment boss 95 situated adjacent an entrance thereof and a support boss 93 integrally formed in the mounting block 87, directly adjacent the channel 97. The support boss 93 includes opposing end portions extending along an axis which is generally perpendicular to the longitudinal axis of the electrode 81.

The torsion spring 89 is defined by a substantially cylindrical body including a pair of coil elements connected to an intermediate brace arm 99 extending outwardly from the cylindrical body. Each coil element includes receiving fingers 99 extending therefrom for providing a pair of receiving fingers 99 situated in a substantially similar plane. The coil elements are positioned over the opposing end portions of support boss 93 such that torsion spring 89 is mounted on the support boss 93 in end mounting block 87 with the pair of receiving fingers 99 extending into the channel 97 and the brace arm 97 abutting a side wall of channel 97 (or a member disposed therebetween, as will be described). The torsion spring 89 is subjected to torsion via tensile forces exerted against fingers 99 so as to create compressive force along a tangential plane on the circumference of the cylindrical core. Put another way, if the spring 89 is forced to twist in one direction, the spring will resist this force and create a twisting force in the opposite direction.

Having described each of the components of the tension mounting, the functional cooperation of each of these components will now be described with reference to FIGS. 2–4. As previously noted, each end mounting block 87 and 88 is fixedly mounted on the shield member 84, at opposed ends thereof, by means of the cooperative engagement of mounting tabs 72 and support apertures 74. Pin array 81 is inserted into channel 97 such that alignment aperture 90 of the electrode 81 engages with alignment boss 95 situated at the entrance of channel 97 on the end mounting block 87 while support apertures 92 are placed into cooperative engagement with the receiving fingers 99 of torsion spring 89. Assuming that the electrode 81 is in an extended condition in order to permit the support apertures 92 to become cooperatively engaged with the receiving fingers 99, the electrode 81 exerts a compressive force on the torsion spring 89 which causes the torsion spring to exert a tensile force against the electrode 81. This force creates the desired tension support mounting of the present invention.

Figure 4:
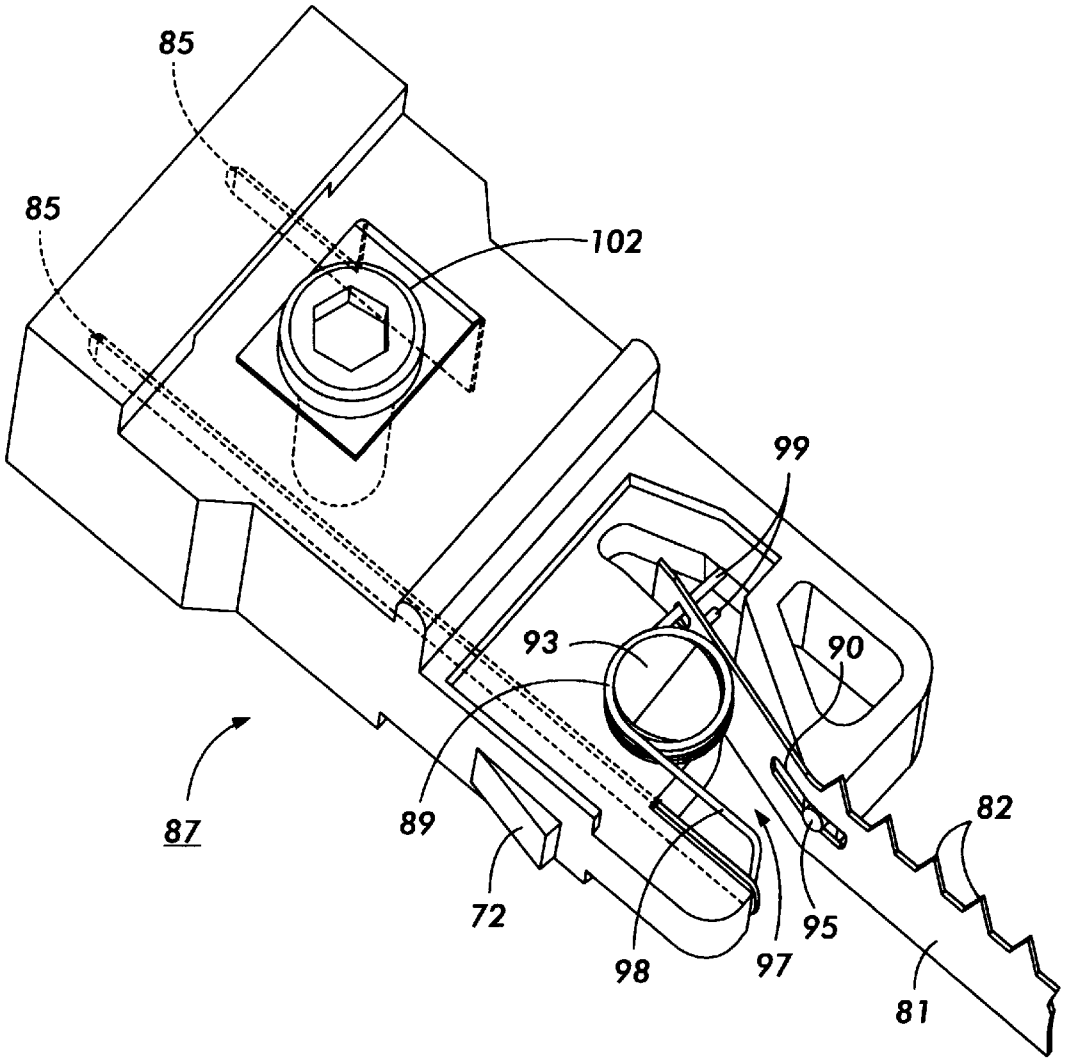
FIG. 4 is a close-up perspective hidden line view of the tension support mounting in accordance with the present invention.

It will be seen from FIG. 4 that the end mounting block 87 may also include embedded high voltage extension members 85 for permitting electrical connection to a high voltage source (not shown). A first extension member extends along a side wall of channel 97 for permitting brace arm 97 to be placed in contact therewith such that the tension spring 89 also acts as an electrical connector for applying high voltage to the electrode 81. Clearly, this feature requires that spring member 89 be fabricated of a conductive material for conducting an electrical biasing potential to the electrode 81. The second extension member extends into the end block mounting 87 and is adapted to receive screw 102 for applying an electrical bias to screen member 100.

It is noted that the tension support mounting of the present invention also provides a relatively easy means for removal and replacement of the pin array electrode 81. The electrode 81 can be removed by placing a tensile force on torsion spring 89, which relaxes the tensile force being exerted against electrode 81. With the tensile force exerted against electrode 81 being relaxed, the electrode can be compressed along its longitudinal axis so as to permit disengagement of the receiving fingers 99 from the support apertures 92 of the electrode. In this manner, the tension support mounting of the present invention can be used to remove the pin array electrode 81 from the corona generating apparatus in order to, for example, replace the pin array electrode 81. Clearly, this process can be reversed in order to replace the electrode. As such, the resilient spring member 89 supplies a force for urging the electrode toward the end mounting block 87, thereby applying tension to the pin array electrode 81. Conversely, the spring member 89 can be compressed for releasing tension on the electrode 81 and permitting replacement thereof. It will be understood that various spring members having various lengths or tensioning strength can be utilized to permit selective application of tension to electrode member 81.

In review, it should be clear from the foregoing discussion that the present invention provides a novel mounting apparatus for applying tension to an electrode in a corona generating device, whereby the electrode is secured to a fixed support member by means of a torsion spring mounted thereon so as to permit application the of tensile stress forces to the electrode. The novel mounting apparatus maintains the electrode in a taut formation within the corona generating device and allows for on-site replacement of the electrode rather than replacement of the entire corona generating device and assembly.

It is, therefore, apparent that there has been provided, in accordance with the present invention, a corona generating device and mounting system therefore that fully satisfies the aims and advantages set forth hereinabove. While the present invention has been described with respect to a specific embodiment thereof, it will be evident to those skilled in the art that many alternatives, modifications and variations are possible for achieving the desired results. Accordingly, the present invention is intended to embrace all such alternatives, modifications, and variations which may fall within the spirit and scope of the following claims.

We claim:

1. A corona generating device, comprising:

an electrode member;

a fixedly positioned end mounting block; and a torsion spring member comprising a conductive material for conducting an electrical biasing potential to said electrode member and mounted on said end mounting block, wherein said torsion spring member is adapted to cooperatively engage said electrode member for applying tension thereto.

2. The corona generating device of claim 1, further including a shield member including a pair of side shield elements for receiving said end mounting block, said shield member is adapted for fixedly supporting said end mounting block between said side shield elements.

3. A corona generating device, comprising:

an electrode member comprising an elongated strip having an array of integral projections extending therefrom;

a fixedly positioned end mounting block; and a torsion spring member mounted on said end mounting block, wherein said torsion spring member is adapted to cooperatively engage said electrode member for applying tension thereto.

4. The corona generating device of claim 1, wherein said end mounting block defines channel for receiving said electrode member with said torsion spring member being disposed in said channel.

5. A corona generating device comprising:

an electrode member;

a fixedly positioned end mounting block defining a channel; and a torsion spring member mounted on said end mounting block, wherein said torsion spring member is adapted to cooperatively engage said electrode member for applying tension thereto, said channel for receiving said electrode member with said torsion spring member disposed in said channel and said mounting block further comprising an alignment boss projecting into said channel for cooperative engagement with said electrode member to align said electrode member.

6. A corona generating device comprising:

an electrode member;

a fixedly positioned end mounting block comprising an integral mounting tab;

a shield member including a pair of side shield elements for receiving said end mounting block, said shield member is adapted for fixedly supporting said end mounting block between said side shield elements, said mounting tab extending in a direction opposed to said shield member, and said shield member adapted to define a fixed mounting support aperture for receiving said mounting tab so as to support said mounting block in a substantially fixed position;

a torsion spring member mounted on said end mounting block, wherein said torsion spring member is adapted to cooperatively engage said electrode member for applying tension thereto.

7. A corona charging device, comprising:

a pin array electrode member, a shield member including a pair of side shield members;

an end mounting block fixedly supported adjacent an end of said shield member, between said pair of side shield members, said end mounting block including a mounting assembly for supporting a torsion spring member; and a torsion spring member supported on the mounting assembly, wherein said torsion spring member is adapted for receiving the pin array electrode.

8. The corona generating device of claim 7, including a pair of said end mounting blocks positioned at opposite ends of said corona generating device, adapted supporting said pin array electode at opposite ends thereof.

9. The corona generating device of claim 7, wherein said end mounting block includes at least one mounting tab extending from a portion thereof; and the shield member is adapted to define at least one mounting support aperture situated adjacent an end portion ends of a shield member thereof;

wherein the mounting tab and the mounting support aperture are adapted for cooperative engagement for fixedly mounting said end block in said shield member.

10. The corona generating device of claim 7, wherein said end mounting block defines a channel including an alignment boss situated adjacent an entrance thereof, said end mounting block further including a support boss integrally formed in the said mounting block directly adjacent the channel.

11. The corona generating device of claim 10, wherein the support boss includes opposing end portions extending along an axis which is generally perpendicular to a longitudinal axis of the pin array electrode.

12. The corona generating device of claim 7, wherein said pin array electrode includes an end portion adapted to define at least one support aperture for cooperative engagement with the torsion spring supported on the mounting assembly of the end mounting block.

13. The corona generating device of claim 7, wherein said torsion spring includes:

a substantially cylindrical body including a pair of coil elements connected to an intermediate brace arm extending outwardly from the cylindrical body; and at least one receiving finger also extending outwardly from the cylindrical body.

14. The corona generating device of claim 13, wherein said torsion spring is adapted to be subjected to torsion via tensile forces exerted thereagainst so as to create compressive force along a circumferencial tangential plane of the cylindrical body.

15. An electrostatographic printing apparatus including a corona charging device, comprising:

a pin array electrode member, a shield member including a pair of side shield members;

an end mounting block fixedly supported adjacent an end of said shield member, between said pair of side shield members, said end mounting block including a mounting assembly for supporting a torsion spring member; and a torsion spring member supported on the mounting assembly, wherein said torsion spring member is adapted for receiving the pin array electrode.

* * * * *